US009821432B2

(12) United States Patent
Breitenmoser et al.

(10) Patent No.: US 9,821,432 B2
(45) Date of Patent: Nov. 21, 2017

(54) EXCHANGEABLE ABRASIVE MEANS FOR AN ABRASION APPLIANCE HAVING A SUCTION EXTRACTION ARRANGEMENT

(71) Applicant: Robert Bosch GmbH, Stuttgart (DE)

(72) Inventors: Josef Breitenmoser, Frauenfeld (CH); Stephan Fritsch, Frauenfeld (CH)

(73) Assignee: Robert Bosch GmbH, Stuttgart (DE)

( * ) Notice: Subject to any disclaimer, the term of this patent is extended or adjusted under 35 U.S.C. 154(b) by 851 days.

(21) Appl. No.: 13/965,603

(22) Filed: Aug. 13, 2013

(65) Prior Publication Data

US 2014/0045413 A1 Feb. 13, 2014

(30) Foreign Application Priority Data

Aug. 13, 2012 (DE) ..... 10 2012 214 382

(51) Int. Cl.
*B24B 55/06* (2006.01)
*B24D 11/00* (2006.01)
*B24B 55/10* (2006.01)

(52) U.S. Cl.
CPC ..... *B24B 55/06* (2013.01); *B24B 55/10* (2013.01); *B24D 11/00* (2013.01)

(58) Field of Classification Search
CPC ..... B24B 55/102; B24B 55/10; B24D 9/085
USPC ..... 451/456, 527, 357, 359
See application file for complete search history.

(56) References Cited

U.S. PATENT DOCUMENTS

| | | | | |
|---|---|---|---|---|
| 5,453,040 | A * | 9/1995 | Schaal | B24B 55/102 451/344 |
| 5,969,112 | A | 10/1999 | Feeman et al. | |
| 5,989,112 | A * | 11/1999 | Long | B24B 55/10 451/456 |
| 7,033,262 | B2 * | 4/2006 | Takizawa | B24D 9/085 451/359 |
| 7,108,594 | B2 | 9/2006 | Swei | |
| D701,249 | S * | 3/2014 | Fritsch | D15/126 |
| 2005/0202769 | A1 * | 9/2005 | Chang | B24D 9/085 451/527 |

* cited by examiner

*Primary Examiner* — Larry E Waggle, Jr.
*Assistant Examiner* — Lauren Beronja
(74) *Attorney, Agent, or Firm* — Maginot, Moore & Beck LLP

(57) ABSTRACT

An exchangeable abrasive mechanism or disc for use on abrasive-mechanism carriers having suction holes includes a plurality of through openings that each have a centroid. The through openings are differentiated into three groups that differ in the radial disposition of the centroids. A first group comprises at least one, but not more than four, through openings of a first cross section. At least two of the through openings of the first group are disposed on a first circumcircle diameter that is substantially identical to one of the hole-circle diameters such that, when the abrasive mechanism is correctly disposed on an abrasive-mechanism carrier, they are in direct alignment with and can overlap, two corresponding suction holes. A second group of through openings of a second, preferably smaller, cross section, comprises at least four through openings that are disposed on a second circumcircle diameter that differs from the first circumcircle diameter.

21 Claims, 8 Drawing Sheets

| | | Through openings | | | | | | | | | | | | |
|---|---|---|---|---|---|---|---|---|---|---|---|---|---|---|
| | Ø | 10 mm | 8 mm | 6 mm | 5 mm | 4 mm | | | | | | | | |
| | Form | | | | | | Σ | $A_{noise}$ / $A_{desc}$ | $\Sigma A_{9_effective}$ | $\Sigma A_{9_effective}$ / $A_{desc}$ | $A_{9_effective}$ / $A_{9_pad}$ | $\Sigma A_{5_effective}$ | $\Sigma A_{5_effective}$ / $A_{desc}$ | $A_{5_effective}$ / $A_{5_pad}$ |
| | A | 78,5 mm² | 50,3 mm² | 28,3 mm² | 19,6 mm² | 12,6 mm² | mm² | | mm² | | | mm² | | |
| Fig. 2 | 6 x | | | 226,2 mm² | | | 540,4 | 4,4% | 311,0 | 2,5% | 49,5% | 276,5 | 2,3% | 70,4% |
| | 4 x | 314,2 mm² | | | | | | | | | | | | |
| Fig. 3 | 4 x | | 201,1 mm² | | 78,5 mm² | | 540,4 | 4,4% | 388,0 | 3,2% | 61,8% | 152,4 | 1,2% | 38,6% |
| | 3 x | 235,6 mm² | | | | | | | | | | | | |
| | 2 x | | | | | 25,1 mm² | | | | | | | | |
| Fig. 4 | 12 x | | | 339,3 mm² | | | 339,3 | 2,8% | 226,2 | 1,8% | 66,0% | 141,4 | 1,2% | 66,0% |
| Fig. 5 | 5 x | | | 141,4 mm² | | | 578,1 | 4,7% | 421,0 | 3,4% | 67,0% | 185,4 | 1,5% | 47,2% |
| | 4 x | | 201,1 mm² | | | | | | | | | | | |
| | 3 x | 235,6 mm² | | | | | | | | | | | | |
| Prior art (Fig. 1b) | Ø | 10 mm | 10 mm | 10 mm | 10 mm | | | | | | | | | |
| | L | 11,5 mm | 6,5 mm | 3,5 mm | 0 mm | | | | | | | | | |
| | Form | | | | | | | | | | | | | |
| | A | 193,5 mm² | 143,5 mm² | 113,5 mm² | 78,5 mm² | | mm² | | mm² | | | mm² | | |
| | 3 x | | | | 235,6 mm² | | 1023,3 | 8,3% | 628,3 | 5,1% | 100,0% | 392,7 | 3,2% | 100,0% |
| | 2 x | 387,1 mm² | 287,1 mm² | | | | | | | | | | | |
| | 1 x | | | 113,5 mm² | | | | | | | | | | |
| 5" Pad (8 suction holes) | 8 x | 628,3 mm² | | | | | 628,3 | 5,1% | 628,3 | 5,1% | 100,0% | - | - | - |
| 5" Pad (5 suction holes) | 5 x | 392,7 mm² | | | | | 392,7 | 3,2% | - | - | - | 392,7 | 3,2% | 100,0% |

Table 1

Fig. 6

EXCHANGEABLE ABRASIVE MEANS FOR AN ABRASION APPLIANCE HAVING A SUCTION EXTRACTION ARRANGEMENT

This application claims priority under 35 U.S.C. §119 to patent application no. DE 10 2012 214 382.3, filed on Aug. 13, 2012 in Germany, the disclosure of which is incorporated herein by reference in its entirety.

BACKGROUND

The disclosure relates to an exchangeable abrasive means, in particular an abrasive disc, for use with a known abrasion appliance having a suction extraction arrangement.

The known abrasion appliance in this case has an abrasive-means carrier having suction holes; in particular, there are known abrasive-means carriers that have either five or eight circular suction holes. In the following, all abrasive-means carriers having five circular suction holes are referred to as a five-hole version, and those having eight circular suction holes are referred to as an eight-hole version. In this case, the suction holes of the known abrasive-means carriers each have substantially the same diameter, and, in the case of the five-hole version, are disposed on a first, larger hole-circle diameter, and, in the case of the eight-hole version, are disposed on a second, smaller hole circle diameter, on the respective abrasive-means carrier. On commercially preferred types of abrasion appliances for abrasive discs that have an overall diameter of 125 mm, the suction holes of the five-hole version are distributed uniformly on a hole-circle diameter of approximately 72 mm, while the suction holes of the eight-hole version are distributed uniformly on a hole-circle diameter of approximately 65 mm. Both preferred versions in this case have a suction hole diameter of approximately 10 mm.

Known from U.S. Pat. No. 5,989,112 are abrasive discs having a plurality of through openings that are suitable for use both on abrasion appliances having a five-hole version and on abrasion appliances having an eight-hole version of the suction holes in the abrasive-means carrier, such that, in both cases of use or application, through openings are assigned to the suction holes in the abrasive-means carrier, such that a maximum suction cross section relative to the suction holes is achieved. A through opening in an abrasive disc, or abrasive means, in this case means, in particular, a two-dimensionally extended relief, in particular aperture, of the abrasive disc, or abrasive means, in a direction perpendicular to a working surface provided with means of abrasion. Further, in this context, a maximum suction cross section is understood to mean the sum of the cross-sectional areas of the suction holes in the abrasive-means carrier, such that the one abrasive disc according to U.S. Pat. No. 5,989,112, when disposed in both cases of use, does not limit the maximum suction cross section, owing to the through openings provided in its surface.

This is achieved, according to U.S. Pat. No. 5,989,112, in that the abrasive disc has eight through openings that, in the case of being disposed on an eight-hole version abrasive-means carrier, are suitable for being in alignment with suction holes respectively assigned to them, preferably for being made to overlap the latter, or for their cross-sectional areas to be overlapped by suction holes respectively assigned to them when the abrasive disc is correctly disposed on the abrasive-means carrier. Further, according to U.S. Pat. No. 5,969,112, five of the eight through openings are enlarged in such a manner that, if the abrasive disc is disposed on a five-hole version abrasive-means carrier, they are suitable for being in alignment with suction holes respectively assigned to them, preferably for being made to overlap the latter, or for their cross-sectional areas to be overlapped by suction holes respectively assigned to them when the abrasive disc is correctly disposed on the abrasive-means carrier. In this case, correct disposition of the abrasive disc on an abrasive-means carrier is understood to mean, in particular, a disposition, fastening, separable fastening or mounting that is aligned in such a manner that the through openings are made to overlap the suction holes assigned to them, according to the type of abrasive-means carrier, such that a maximum possible suction cross section is achieved.

However, these known abrasive discs have the disadvantage, on the one hand, that, in both cases of application, the optimum possible working surface is not available and, on the other hand, the connection capacity, in particular attachment capacities, or the connecting or attachment surface of the abrasive disc on the abrasive-means carrier, in particular in the case of known hook/loop or adhesive systems for attaching abrasive discs to an abrasive-means carrier, are adversely affected.

SUMMARY

The exchangeable abrasive means according to the disclosure have the advantage that, on the one hand, a sufficiently large maximum suction cross section with, at the same time, significantly improved connection capacity. This results in an advantageously improved service life of the abrasive means according to the disclosure. For this purpose, the abrasive means according to the disclosure has a plurality of through openings, which each have a cross-sectional area that has a centroid, wherein the plurality of through openings can be differentiated into three groups of through openings, the groups differing from each other in the radial disposition of the centroids of the respective through openings. A centroid in this case is understood to mean, in particular, a point in the cross-sectional area that, in the case of a notional homogeneous and isotropic distribution of an assumed area density, would correspond to the center of gravity. In the case of a circular cross section, the centroid corresponds, in particular, to the mid-point of the circle. A first group of the through openings comprises at least one, but not more than four, but preferably two or three through openings of a first cross section that, particularly preferably, is at the same time the largest of the cross sections of all through openings. At least two of the through openings of the first group in this case are disposed on a first circumcircle diameter that is substantially identical to one of the hole-circle diameters, in such a manner that, when the abrasive means is correctly disposed on an abrasive-means carrier, they are in direct alignment with, and can preferably be made to overlap, two suction holes respectively assigned to them.

Further, the abrasive means according to the disclosure has a second group of through openings, of a second, preferably smaller cross section, which comprises at least four through openings that are disposed on a second circumcircle diameter that differs from the first circumcircle diameter.

Advantageous developments and improvements of the features specified in the disclosure ensue from the measures stated in the dependent claims.

In a preferred embodiment, the second group of through openings of an abrasive means according to the disclosure comprises at least five, preferably exactly five or six, through openings.

In an advantageous development of the abrasive means according to the disclosure, at least one third group of through openings is provided, the centroids of these through openings being disposed neither on the first nor on the second circumcircle diameter. Preferably, the third group comprises a plurality of through openings, the centroid of a first part of the plurality lying radially outside of the first circumcircle diameter, and a second part of the plurality lying radially inside the second circumcircle diameter, the through openings of the plurality preferably being disposed such that, when the abrasive means is correctly disposed on an abrasive-means carrier, their cross-sectional areas are each overlapped by the suction holes assigned to them. A particularly effective embodiment is obtained if the third group comprises at least one through opening, whose centroid is disposed between the first and the second circumcircle diameter, the cross-sectional area of this through opening being overlapped by a suction hole assigned thereto, when the abrasive means is correctly disposed on an abrasive-means carrier. Preferably, a cross section of the respective suction hole is touched, at least tangentially, by the cross-sectional area of the through openings, such that the cross-sectional area of the respective through opening lies inside the cross section of the respective suction hole.

An embodiment of an abrasive means according to the disclosure that is particularly easily produced, and also easily applied, is achieved in that the cross-sectional areas of at least one of the groups of through openings are circular. An abrasive means according to the disclosure can be produced particularly inexpensively if the cross-sectional areas of all groups of through openings are circular in form, since circular through openings can be realized by punching technology, for example by means of easily produced tools.

In an advantageous embodiment, the cross-sectional areas of the through openings of the first group are circular and have a uniform first diameter D1_1. Preferably, the first diameter D1_1 of the through openings of the first group is between 70% and 105%, ideally approximately 80% and 100%, of the diameters of the suction holes of the abrasive-means carrier, preferably between 8 mm and 10 mm.

In an advantageous development, the cross-sectional areas of the through openings of the second group are circular and have at least one, preferably two, differing diameters D2_1, D2_2. The second group preferably therefore consists of at least two sub-groups of through openings that differ by a diameter D2_1, D2_2 of the cross-sectional area. Owing to the realization with two differing diameters D2_1, D2_2, a maximum possible suction cross section can be easily realized, while at the same time minimizing a loss of connection area. In preferred embodiments, the diameter D2_1 of the cross-sectional area of a first sub-group of the second group is equal to or greater than the diameter D1_1 of the cross-sectional area of the through openings of the first group, and the diameter D2_2 of the cross-sectional area of a second sub-group of the second group is less than or equal to the diameter D1_1 of the cross-sectional area of the through openings of the first group. Preferably, in this case, the first sub-group comprises at least one through opening, preferably three through openings, the diameter D2_1 being, particularly preferably, between 70% and 105%, ideally approximately 100% of the diameters of the suction holes of the abrasive-means carrier. Additionally or alternatively, the second sub-group can comprise at least two through openings, preferably four through openings, the diameter D2_2 being, particularly preferably, between 50% and 85%, ideally approximately 60% to 80% of the diameters of the suction holes of the abrasive-means carrier, and being not greater than the diameter D2_1 of the first sub-group.

Moreover, advantageous abrasive means according to the disclosure can be achieved in that the cross-sectional area of the through openings of the third group are circular and have at least one, preferably two, differing diameters D3_1, D3_2, the second group preferably therefore consisting of at least two sub-groups of through openings that differ in a diameter D3_1, D3_2 of the cross-sectional area.

It is also advantageous to limit the number of through openings of the third group, whereby the maximum possible suction cross section can be realized, while at the same time minimizing a loss of connection area. Preferably, for this purpose, the third group comprises five or six through openings.

BRIEF DESCRIPTION OF THE DRAWINGS

Exemplary embodiments of the disclosure are represented in the drawings and explained in greater detail in the following description. In the drawings.

DETAILED DESCRIPTION

Figure 1A:
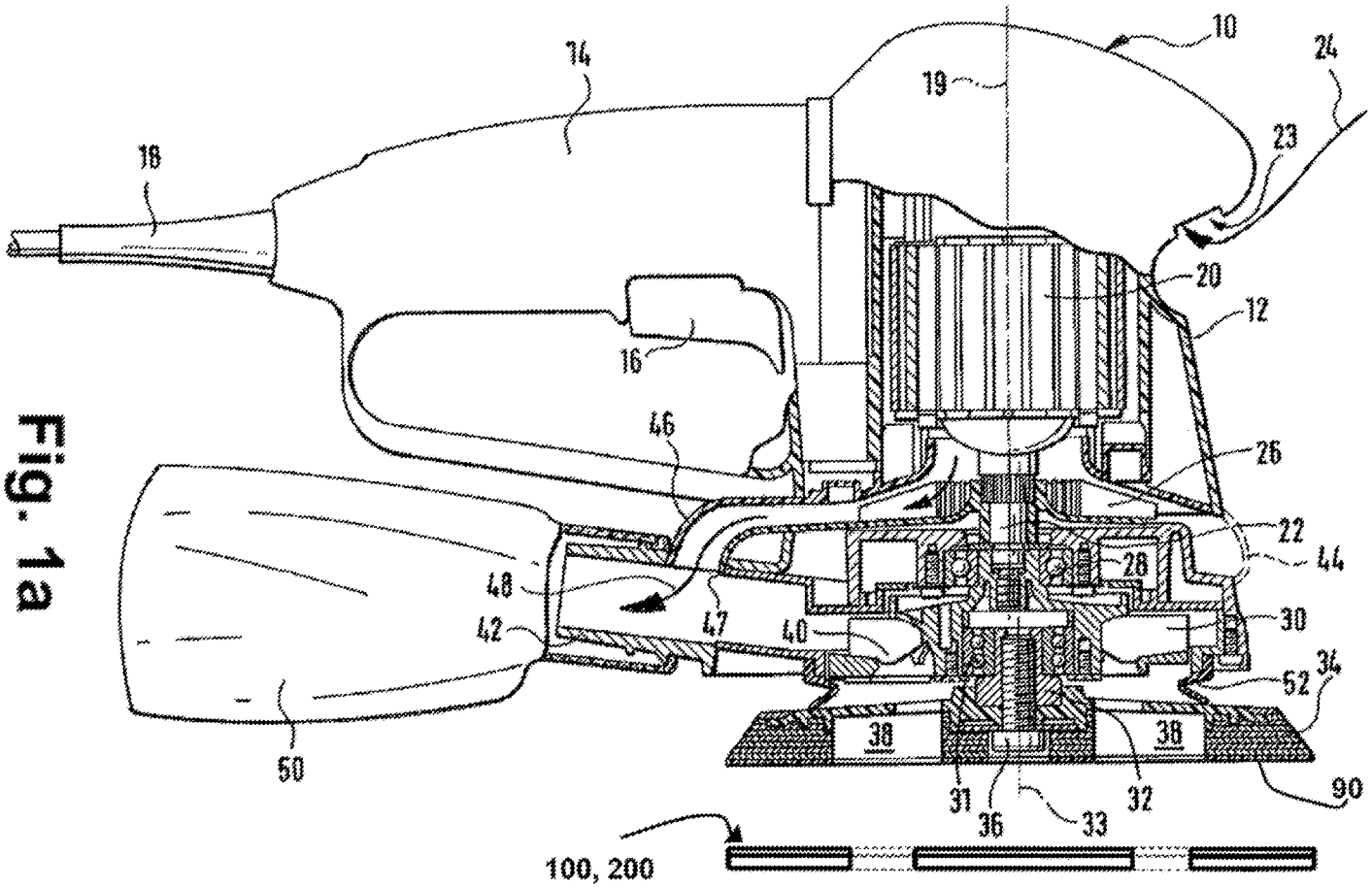
FIG. 1*a* shows an orbital sander as an example of a known abrasion appliance for the use of exchangeable abrasive means.

FIG. 1*a* shows, exemplarily, a known abrasion appliance 10, designed as an orbital sander, having a housing 12 that, in the direction of view to the left, has a horizontal handle 14, which carries a manually operable switch button 16 of a switch, not represented, for starting and stopping the motor 20.

An electric cable 18, which serves to supply the motor 20 with energy, emerges at the rear end of the handle 14.

The housing 12 carries the motor 20 with a motor axis 19 that extends perpendicularly in relation to the handle 14 and in the downward extension of which a motor shaft 22 projects out of the motor 20. The end of the motor shaft is encompassed in a rotationally fixed manner by a cooling ventilator 26, which conveys air radially outward, in the direction of the cooling exhaust-air arrow 48. As a result, in the upper region of the housing 12, at cooling slots 23 of the housing 12, there is an intake of cooling external air, which can flow into the housing 12 and past the motor 20, according to the cooling inflow arrow 24, and can then leave the housing 12 through a connecting channel 46, via the suction stub 42.

Since the connecting channel 46 widens radially, in particular in the region of its opening 47 into the suction stub 42, the cooling exhaust air flows along the directional arrow 48 and generates an additional negative pressure—as with an injector pump—in the dust suction channel 40. This results in an intensified discharge of ground-off material from suction holes 38, realized in the abrasive-means carrier 34, which is realized as a backing pad, toward the dust box 50.

The housing 12 surrounding the cooling ventilator 26 is sealed in the axially downward direction, and has the lower end of the motor shaft 22 extending through it. The latter is rotatably mounted there in a roller bearing 28.

In the bell-type region that faces away from the cooling ventilator 26, the free end of the motor shaft 22 carries a dust ventilator 30, which sucks in dust and ground-off material, through the suction holes 38 realized in the abrasive-means carrier 34, and blows this air and material out to the suction stub 42.

An annular sealing lip 52 seated at the lower edge of the housing 12 is supported, so as to be resiliently biased in the axial direction, on the top of the abrasive-means carrier 34. As a result, the space between the housing 12 and the abrasive-means carrier 34 is sealed off against disturbing infiltrated air, and the removal of ground-off material is rendered highly efficient.

Downwardly, toward the abrasive-means carrier 34, the dust ventilator 30 has an eccentric opening, not designated in greater detail, which serves as a bearing seat for a ball bearing 31. This eccentrically seated ball bearing 31 carries an eccentric pin 32, which can be connected to the abrasive-means carrier 34 in a rotationally fixed manner by means of a screw 36.

When the motor shaft 22 rotates, the eccentric 32 follows this rotation, because of the bearing friction of the ball bearing 31, in that it rotates about its eccentric axis 33 and, at the same time, orbits about the motor axis 19, or the motor shaft 22. This results in the characteristic orbital, oscillating motion of the abrasive-means carrier 34 that is usual in the case of orbital sanders.

The abrasive-means carrier 34 of the known abrasion appliance 10 is mounted/mountable at least on a fastening surface 90 that faces away from the abrasion appliance 10 and that preferably has attachment means, not represented in greater detail here, for exchangeably fastening abrasive means 100, 200 to the abrasive-means carrier 34. Persons skilled in the art are familiar with a very great variety of attachment means for this purpose, from which they may select according to the intended application of the abrasion appliance 10 and the anticipated demands upon the abrasion appliance 10, without this selection affecting the character of the present disclosure. Particularly common attachment means are, on the one hand, realization with catching hooks, as a catching surface, or, alternatively, design as a flat adhesive plate for fastening exchangeable abrasive means by adhesion. Also possible, however, are other adhesive fastening methods such as, for example, electrostatic attachment by means of a fastening surface 90 realized as an electrostatic attachment plate, or other attachment means familiar to persons skilled in the art. Alternatively or complementarily, a clamping device may be provided on the abrasive-means carrier 34, for the purpose of fixing the exchangeable abrasive means.

An exchangeable abrasive means 100, 200 in this case preferably has at least a two-layer, or two-ply, structure. The first layer, which, when correctly attached to the abrasive-means carrier 34, faces toward the latter, is in this case realized as a fastening layer 102, 202, and preferably has fastening means that correspond to the attachment means on the fastening surface 90 of the abrasive-means carrier 34. In a preferred embodiment, the fastening layer 102, 202 is realized as a hook/loop fleece; particularly preferably, the fastening layer is composed substantially of the hook/loop fleece. In another known embodiment, the fastening layer 102, 202 is realized as a pressure-sensitive adhesive system, which preferably comprises a pressure-sensitive adhesive layer, and particularly preferably is substantially composed of the latter. Frequently, when realized as a pressure-sensitive adhesive system, fastening layers 102, 202 additionally have on their surface a detachable protective film, which serves substantially to protect the adhesive layer, and which, accordingly, must be pulled off before the exchangeable abrasive means 100, 200 is applied to the abrasive-means carrier 34.

The second layer 104, 204, which is substantially opposite the first layer, comprises a working ply; preferably, the second layer 104, 204 is composed substantially of the working ply. In a preferred embodiment of the working ply, the latter is realized as an abrasion ply, wherein an abrasion ply is understood to mean, in particular, a ply or ply system that has at least abrasive particles, in particular sanding particles.

Figure 1B:
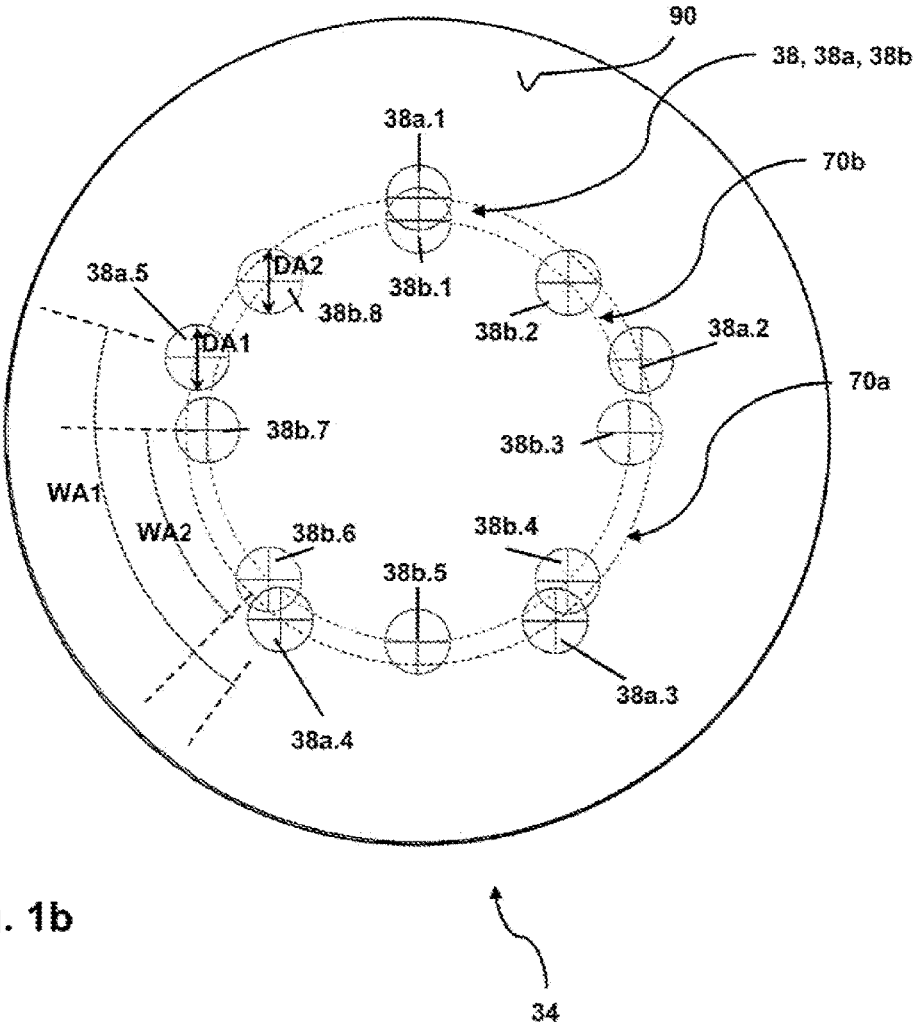
FIG. 1*b* shows a schematic plan view of the arrangement of the suction holes of a known abrasive-means carrier according to FIG. 1*a* in a five-hole or eight-hole version.

FIG. 1*b* shows a schematic plan view of the fastening surface 90 of the abrasive-means carrier 34, wherein represented the position of suction holes 38, 38*a*, 38*b* of two known, very common configurations.

The first, radially more outer configuration represents the five-hole version of suction holes 38*a* that was mentioned at the outset. In this case, the suction holes 38*a* are disposed on a first hole-circle diameter 70*a*. In a preferred embodiment, the hole-circle diameter 70*a* is between 67 and 75 mm, preferably approximately 72 mm. Preferably, the five suction holes 38*a*.1 to 38*a*.5 in this case are disposed with a uniform angular spacing WA1 on the first hole-circle diameter 70*a*. In particular, the suction holes 38*a* are circular in form, and have a first diameter DA1. In a preferred embodiment, the diameter DA1 of the suction holes 38*a* in this case is between 6 and 12 mm, in particular between 8 and 11 mm, particularly preferably approximately 10 mm.

The second, radially more inner configuration represents the eight-hole version of suction holes 38*b* that was mentioned at the outset. In this case, the suction holes 38*b* are disposed on a second hole-circle diameter 70*b*. In a preferred embodiment, the hole-circle diameter 70*b* is between 60 and 67 mm, preferably approximately 65 mm. Preferably, the eight suction holes 38*b*.1 to 38*b*.8 in this case are disposed with a uniform angular spacing WA2 on the second hole-circle diameter 70*b*. In a preferred realization, the suction holes 38*b* are circular in form, and have a second diameter DA2, the diameter DA2, particularly preferably, being substantially equal to the diameter DA1. In a preferred embodiment, the diameter DA2 of the suction holes 38*b* in this case is between 6 and 12 mm, in particular between 8 and 11 mm, particularly preferably approximately 10 mm.

Figure 1C:
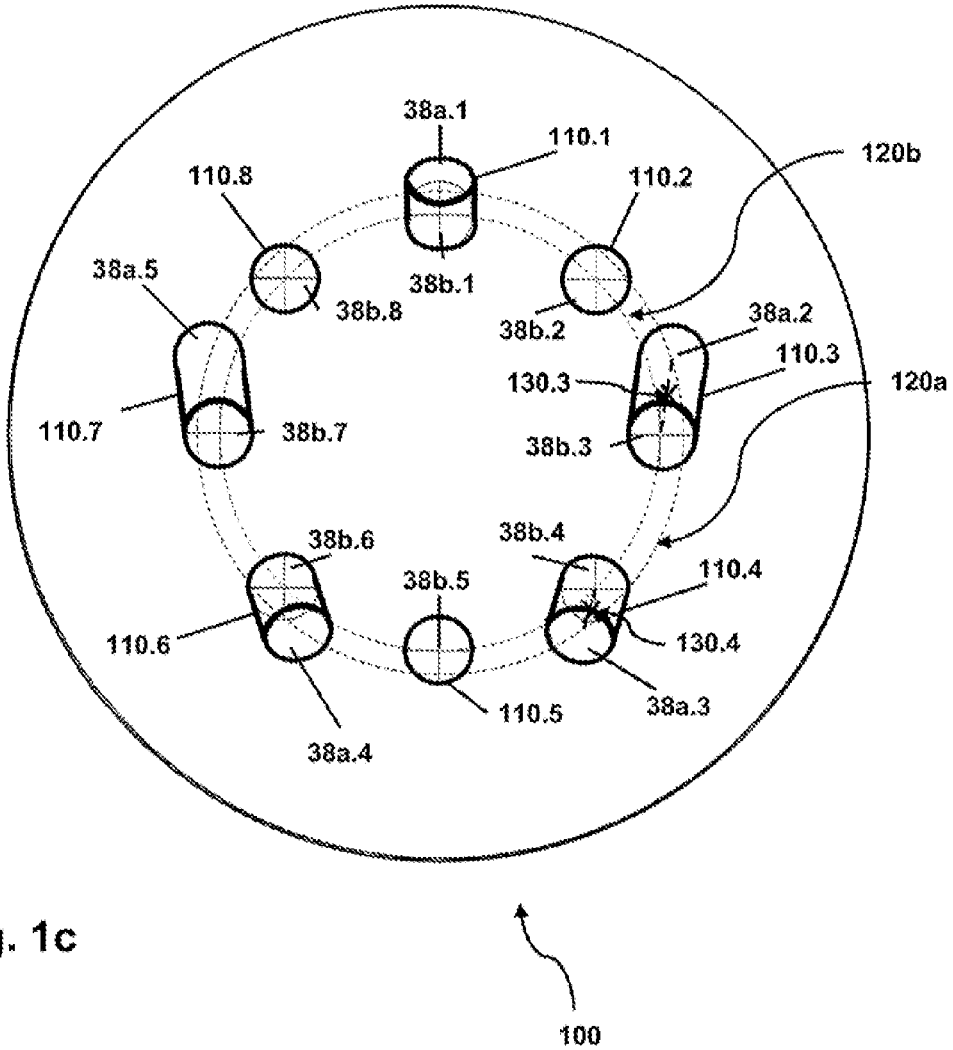
FIG. 1*c* shows a known abrasive disc according to U.S. Pat. No. 5,989,112 and its disposition on an abrasive-means carrier according to FIG. 1*b;*

A known abrasive disc 100 according to U.S. Pat. No. 5,989,112, as an example of an exchangeable abrasive means, and its disposition on an abrasive-means carrier 34 according to FIG. 1*b*, is represented in FIG. 1*c*. The abrasive disc 100 has a total of eight through openings 110.1 to 110.8, which extend substantially through the abrasive disc 100, transversely in relation to the latter. When the abrasive disc 100 is correctly disposed on an eight-hole version abrasive-means carrier 34, as a result of being correctly positioned, the circular through openings 110.2, 110.5 and 110.8 overlap the suction holes 38*b*.2, 38*b*.5 and 38*b*.8 respectively assigned to them. Preferably, three of the through openings 110.2, 110.5 and 110.8 have a cross-sectional diameter that is substantially identical to the diameter DA2. The center points of the opening cross sections of the through openings 110.2, 110.5 and 110.8 in this case lie on a circumcircle diameter 120*b* that corresponds substantially to the hole-circle diameter DA2, preferably being identical to the latter. According to U.S. Pat. No. 5,989,112, the remaining five through openings 110.1, 110.3, 110.4, 110.6 and 110.7 are realized differently, as elongated holes, a first center point of the semicircles delimiting the respective elongated hole being in each case disposed on the circumcircle diameter 120 in such a manner that, when the abrasive disc 100 is disposed in the correct position on an eight-hole version abrasive-means carrier 34, the elongated holes of the through openings 110.1, 110.3, 110.4, 110.6 and 110.7 almost completely overlap the suction holes 38*b*.1, 38*b*.3, 38*b*.4, 38*b*.6 and 38*b*.7 respectively assigned to them.

According to U.S. Pat. No. 5,989,112, the eccentricity of the through openings 110.1, 110.3, 110.4, 110.6 and 110.7, realized as elongated holes i.e. the distance from the first to the respective second center point of the semicircles delimiting the respective elongated hole, is determined in that these center points are disposed on a circumcircle diameter 120*a*, which is substantially the same as the hole-circle diameter 70*a*, in such a manner that, when the abrasive disc 100 is disposed in the correct position on a five-hole version abrasive-means carrier 34, the through openings 110.1, 110.3, 110.4, 110.6 and 110.7 the elongated holes of the through openings 110.1, 110.3, 110.4, 110.6 and 110.7 almost completely overlap the suction holes 38*a*.1 to 38*a*.5 respectively assigned to them. A centroid 130.1, 130.3, 130.4, 130.6 and 130.7—in FIG. 1*c*, only the centroids 130.3 and 130.4 are represented pictorially in this case—of the respective elongated holes in this case lies, respectively, on a connecting straight line between the respective first and second center point of the corresponding elongated hole, in particular on the center point of this connecting straight line, and therefore radially between the circumcircle diameter 120*a* and the circumcircle diameter 120*b*.

Figure 2:
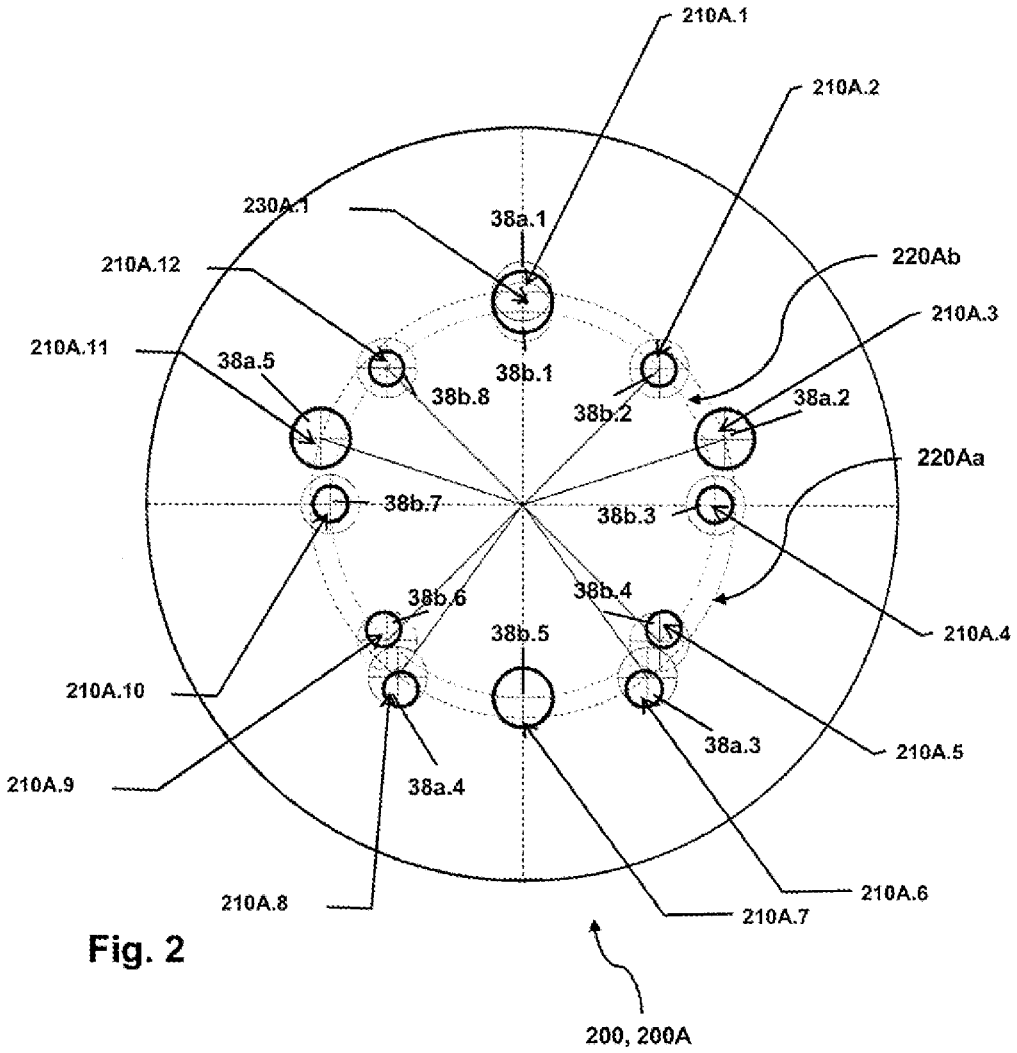
FIG. 2 shows a first exemplary embodiment of an exchangeable abrasive means according to the disclosure.

FIG. 2 shows the schematic plan view of a first exemplary embodiment of an exchangeable abrasive means 200, 200A according to the disclosure, realized as an abrasive disc. The exchangeable abrasive means according to FIG. 2 in this case has a total of twelve through openings 210A.1-210A.12. In the preferred example according to FIG. 2, all through openings 201A.1-210A.12 each have a circular cross-sectional area, such that their respective centroid 230A.1-230A.12 coincides with the respective center point of the circular cross-sectional area. For reasons of clarity, only the centroid 230A.1 is indicated in this case, but the same applies, analogously, to all through openings of the embodiments according to the disclosure.

In respect of a radial disposition of the through openings 210A.1-210A.12, three groups of through openings can be distinguished in the preferred example according to FIG. 2.

In this case, the centroids 230A.3 and 230A.11 of two through openings 210A.3 and 210A.11 are disposed on a first circumcircle 220Aa, the diameter of which preferably corresponds substantially to the hole-circle diameter 70*a* of the five-hole version abrasive-means carrier 34. In a particularly preferred embodiment, the centroids 230A.3 and 230A.11 are in this case disposed on the first circumcircle diameter 220Aa in such a manner that, when the exchangeable abrasive means 200A is correctly disposed, or disposed in the correct position, on a five-hole version abrasive-means carrier 34, they can be made to substantially overlap the center points of the suction holes 38*a*.2 and 38*a*.5. The through openings 210A.3 and 210A.11 thus constitute a first group 240A of through openings 210A. Preferably, in this case, a diameter D1_1 of the circular cross-sectional areas of the through openings 210A.3 and 210A.11 corresponds to the diameter DA1 of the suction holes 38*a*. In a preferred embodiment, the diameter D1_1 of the through openings 210A.3 and 210A.11 of the first group 240A is between 6 and 12 mm, in particular between 8 and 11 mm, particularly preferably approximately 10 mm.

A second group 250A of through openings is distinguished in that their centroids are disposed on a second circumcircle diameter 220Ab, the diameter of which preferably corresponds substantially to the hole-circle diameter 70*b* of the eight-hole version abrasive-means carrier 34 version. In the preferred embodiment according to FIG. 2, the four through openings 210A.2, 210A.4, 210A.10 and 210A.12 therefore constitute the second group 250A. Preferably, in this case, the centroids 230A.2, 230A.4, 230A.10 and 230A.12 are each disposed on the second circumcircle diameter 220Ab in such a manner that, when the exchangeable abrasive means 200A is correctly disposed, or disposed in the correct position, on an eight-hole version abrasive-means carrier 34, they can be made to substantially overlap the respective center points of the suction holes 38*b*.2, 38*b*.3, 38*b*.7 and 38*a*.8. Preferably, in this case, the circular cross-sectional areas of the second group 250A have a diameter D2_1 that is smaller than the diameter DA1 of the suction holes 38*a*. In a preferred embodiment, the diameter D2_1 of the through openings of the second group 250A is between 4 and 9 mm, in particular between 5 and 7 mm, particularly preferably approximately 6 mm.

Provided in the embodiment according to FIG. 2 is a third group 260*a* of through openings, whose centroids are not disposed either of the circumcircle diameters 220Aa, 220Ab. These through openings, likewise, preferably have a circular cross-sectional area in this case, such that the respective centroid coincides with the center point of the circle forming the cross-sectional area. According to the preferred embodiment according to FIG. 2, the through openings of the third group 260A in this case are assigned to the suction holes 38*b*.4, 38*a*.3, 38*a*.4 and 38*b*.6 in such a manner that, when the exchangeable abrasive means 220A is correctly disposed, or disposed in the correct position, on an abrasive-means carrier 34, their cross-sectional areas can be completely overlapped by these suction holes. In the embodiment according to FIG. 2, the through openings 210A.6 and 210A.8 are in this case assigned to the suction holes 38*a*.3 and 38*a*.4, the respective centroids 230A.6 and 230A.8 being located inside the cross sections of the suction holes 38*a*.3 and 38*a*.4, and a circumferential line of the through openings 210A.6 and 210A.8 preferably touching a circumferential line of the suction holes 38*a*.3 and 38*a*.4 radially from the inside, but substantially not overlapping the latter. Furthermore, in the embodiment according to FIG. 2, the through openings 210A.5 and 210A.9 are assigned to the suction holes 38*b*.4 and 38*b*.6, the respective centroids 230A.5 and 230A.9 being located inside the cross sections of the suction holes 38*b*.4 and 38*b*.6, and a circumferential line of the through openings 210A.5 and 210A.9 preferably touching a circumferential line of the suction holes 38*b*.4 and 38*b*.6 radially from the inside, but substantially not overlapping the latter. Preferably, in this case, the circular cross-sectional area of the through openings 210A.5, 210A.6, 210A.8 and 210A.9 has a diameter D3_1 that is smaller than the diameter DA1 of the suction holes 38*a*, 38*b*, its diameter D3_1 preferably in this case being between 4 and 9 mm, in particular between 5 and 7 mm, particularly preferably approximately 6 mm.

Furthermore, with the through opening 210A.1, the third group 260A comprises a fifth element, whose centroid 230A.1 is disposed between the circumcircle diameters 220Aa, 220Ab in such a manner that, depending on the hole version of the abrasive-means carrier 34, at least 50%, preferably at least 70%, in particular preferably at least 80% of a cross-sectional area of the through opening 210A.1 can be overlapped, either by the suction hole 38*a*.1 or by the suction hole 38*b*.1. In particular, the centroid 230A.1 in this case lies on a circumcircle diameter that preferably corresponds substantially to a mean value of the circumcircle diameters 220Aa and 220Ab. In a preferred embodiment according to FIG. 2, a diameter D3_2 of the circular cross-sectional areas of the through openings 210A.1 corresponds in this case to the larger of the diameters DA1, DA2 of the suction holes 38*a*, 38*b*. In a preferred embodiment, the diameter D3_2 of the through opening 210A.1 in this case is between 6 and 12 mm, in particular between 8 and 11 mm, particularly preferably approximately 10 mm.

Figure 3:
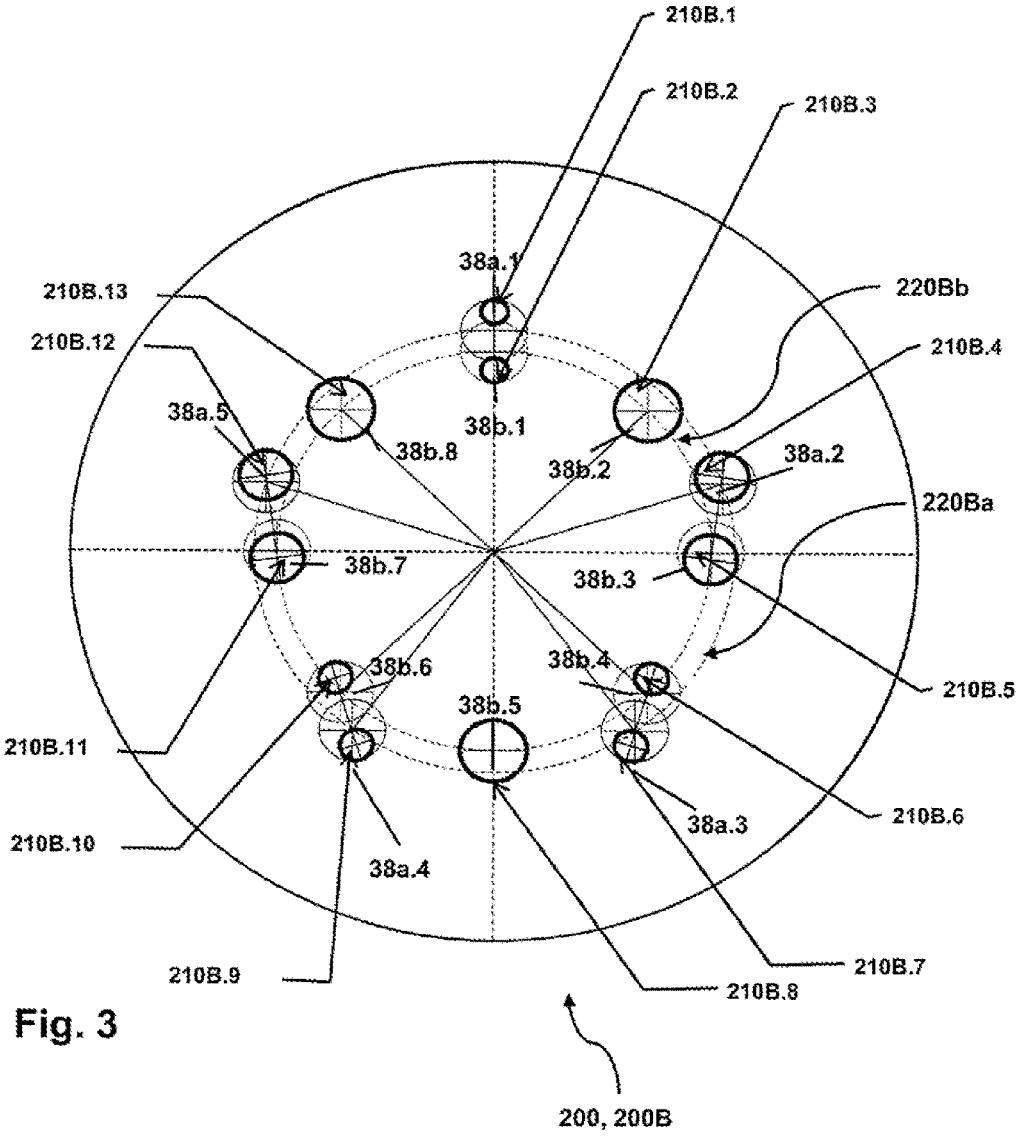
FIG. 3 shows a second exemplary embodiment of an exchangeable abrasive means according to the disclosure.

FIG. 3 shows the schematic top view of a second exemplary embodiment of an exchangeable abrasive means 200, 200*b* according to the disclosure, realized as an abrasive disc. The exchangeable abrasive means 200B according to FIG. 3 in this case has a total of thirteen through openings 210B.1-210B.13. In the preferred example according to FIG. 3, all through openings 201B.1-210B.13 each have a circular cross-sectional area, such that their respective centroid 230B.1-230B.13 coincides with the respective center point of the circular cross-sectional area. The second exemplary embodiment in this case differs from the embodiment from FIG. 2 substantially in the following points:

A first group 240B of through openings is distinguished in that their centroids are disposed on a circumcircle diameter 220Ba, the diameter of which preferably corresponds substantially to the hole-circle diameter 70*a* of the abrasive-means carrier 34 in the five-hole version. In the preferred embodiment according to FIG. 3, the two through openings 210B.4 and 210B.12 thus constitute the first group 240B. Preferably, in this case, the centroids 230B.4 and 230A.12 are each disposed on the circumcircle diameter 220Ba in such a manner that, when the exchangeable abrasive means 200*b* is correctly disposed, or disposed in the correct position, on a five-hole version abrasive-means carrier 34, they can be substantially overlapped by the suction holes 38*a*.2 and 38*a*.5. Preferably, in this case, the circular cross-sectional areas of the first group 240B have a diameter D1_1 that is smaller than the diameter DA1 of the suction holes 38*a*. In a preferred embodiment, the diameter D1_1 of the through openings of the first group 240B in this case is between 6 and 9 mm, particularly preferably approximately 8 mm.

In this example, a second group 250B comprises the five through openings 210B.3, 210B.5, 210B.8, 210B.11 and 210B.13, whose centroids 230B.3, 230B.5, 230B.8, 230B.11 and 230B.13 are disposed on a circumcircle diameter 220Bb that is substantially identical to the hole-circle diameter 70*b*. In the preferred embodiment according to FIG. 3, the centroids 210B.3, 210B.8 and 210B.13 are in this case disposed in a distributed manner on the circumcircle diameter, in such a manner that, when the exchangeable abrasive means 200B is correctly disposed, or disposed in the correct position, on an eight-hole version abrasive-means carrier 34, they can be made to substantially overlap the center points of the suction holes 38*b*.2, 38*b*.5 and 38*b*.8. Preferably, in this case, a diameter of the circular cross-sectional areas of the through openings 210B.3, 210B.8 and 210B.13 corresponds to the diameter DA2 of the suction holes 38*b*. In a preferred embodiment, the diameter D2_1 of the through openings 210B.3, 210B.8 and 210B.13 of the second group 250B in this case is between 6 and 12 mm, in particular between 8 and 11 mm, particularly preferably approximately 10 mm. The two remaining through openings 210B.5 and 210B.11 of the second group 250B according to FIG. 3 have centroids 230B.5 and 230B.11 that are disposed on the circumcircle diameter 220Bb in such a manner that, when the exchangeable abrasive means 200*b* is correctly disposed, or disposed in the correct position, on an eight-hole version abrasive-means carrier 34, they are overlapped substantially by the cross-sectional areas of the suction holes 38*b*.3 and 38*b*.7. In a preferred embodiment according to FIG. 3, the circular cross-sectional areas of the through holes 210B.5 and 210B.11 in this case preferably have a diameter D2_2 of between 6 and 9 mm, particularly preferably of approximately 8 mm.

According to FIG. 3, a third group 260B preferably comprises six through openings, whose respective centroids are not disposed on one of the circumcircles 220B a, 220Bb. In this case, the four through openings 210B.6, 210B.7, 210B.9 and 210B.10 correspond, in their position in relation to the suction holes 38*b*.4, 38*a*.3, 38*a*.4 and 38*b*.6, substantially to the through openings 210A.5, 210A.6, 210A.8 and 210A.9 known from FIG. 2. In the preferred embodiment according to FIG. 3, the preferably circular cross-sectional area of the through openings 210B.6, 210B.7, 210B.9 and 210B.10 has a diameter D3_1 that is smaller than the diameter DA1, DA2 of the suction holes 38*a*, 38*b*, its diameter D3_1 in this case preferably being between 3 and 8 mm, in particular between 4 and 7 mm, particularly preferably approximately 5 mm.

The remaining two through openings 210B.1 and 210B.2 of the third group 260B of the exemplary embodiment according to FIG. 3 are disposed outside of the circumcircles 220Ba, 220Bb in such a manner that the through opening 210B.1 is assigned to the suction hole 38*a*.1, and the through opening 210B.2 is assigned to the suction hole 38*b*.1, in such a manner that the cross-sectional area of the through openings 210B.1, 210B.2 is substantially not overlapped, preferably not overlapped at all, by the respectively other suction hole 38*b*.1 or 38*a*.1. In the preferred embodiment according to FIG. 3, the preferably circular cross-sectional area of the through openings 210B.1 and 210B.2 has a diameter D3_2 that is smaller than the diameter DA1, DA2 of the suction holes 38*a*, 38*b*, its diameter D3_2 in this case preferably being between 3 and 5 mm, particularly preferably approximately 4 mm.

Figure 4:
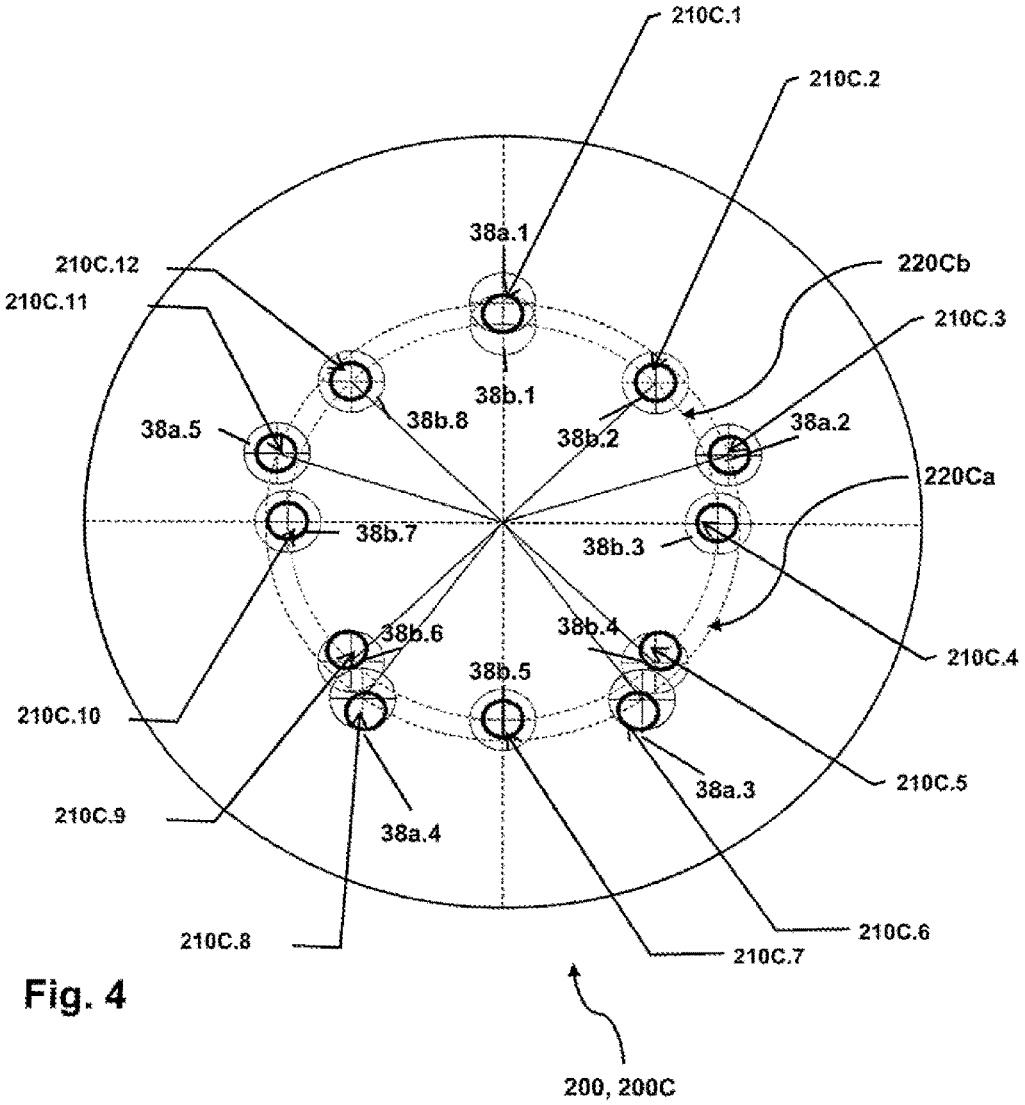
FIG. 4 shows a third exemplary embodiment of an exchangeable abrasive means according to the disclosure.

A further preferred embodiment of the disclosure is represented in FIG. 4. In this case, FIG. 4 shows the schematic plan view of a third exemplary embodiment of an exchangeable abrasive means 200, 200C according to the disclosure, realized as an abrasive disc. The exchangeable abrasive means 200C according to FIG. 4 in this case has a total of twelve through openings 210C.1-210C.12. In the preferred example according to FIG. 4, all through openings 201C.1-210C.12 each have a circular cross-sectional area, of substantially identical diameter, their respective centroid 230C.1-230C.12 coinciding with the respective center point of the circular cross-sectional area.

In this case, the centroids 230C.3 and 230CA.11 of two through openings 210C.3 and 210C.11 are disposed on a first circumcircle diameter 220Ca, the diameter of which preferably corresponds substantially to the hole-circle diameter 70*a* of the abrasive-means carrier 34 in the five-hole version. In a particularly preferred embodiment, the centroids 230C.3 and 230C.11 are in this case disposed on the first circumcircle diameter 220Aa in such a manner that, when the exchangeable abrasive means 200A is correctly disposed, or disposed in the correct position, on a five-hole version abrasive-means carrier 34, they can be made to substantially overlap the center points of the suction holes 38*a*.2 and 38*a*.5. The through openings 210C.3 and 210C.11 thus constitute a first group 240C of through openings 210C. Preferably, in this case, a diameter D1_1 of the circular cross-sectional areas of the through openings 210C.3 and 210C.11 is smaller the diameter DA1 of the suction holes 38*a*. In a preferred embodiment, the diameter D1_1 of the through openings 210C.3 and 210C.11 of the first group 240C in this case is between 4 and 9 mm, in particular between 5 and 7 mm, particularly preferably approximately 6 mm.

A second group 250C of through openings is distinguished in that their centroids are disposed on a second circumcircle diameter 220Cb, the diameter of which preferably corresponds substantially to the hole-circle diameter 70*b* of the abrasive-means carrier 34 in the eight-hole version. In the preferred embodiment according to FIG. 4, the five through openings 210C.2, 210C.4, 210C.7, 210C.10 and 210C.12 thus constitute the second group 250C. Preferably, in this case, the centroids 230C.2, 230C.4, 230C.7, 230C.10 and 230C.12 are each disposed on the second circumcircle diameter 220Cb in such a manner that, when the exchangeable abrasive means 200C is correctly disposed, or disposed in the correct position, on an eight-hole version abrasive-means carrier 34, they can be made to substantially overlap the respective center points of the suction holes 38*b*.2, 38*b*.3, 38*b*.5, 38*b*.7 and 38*a*.8. Preferably, in this case, the circular cross-sectional areas of the second group 250C have a diameter D2_1 that is smaller than the diameter DA2 of the suction holes 38*b*. In a preferred embodiment, the diameter D2_1 of the through openings of the second group 250C in this case is between 4 and 9 mm, in particular between 5 and 7 mm, particularly preferably approximately 6 mm.

According to FIG. 4, a third group 260C preferably comprises five through openings, whose respective centroid is not disposed on one of the circumcircles 220Ca, 220Cb. In this case, the four through openings 210C.5, 210C.6, 210C.8 and 210C.9 correspond, in their position in relation to the suction holes 38*b*.4, 38*a*.3, 38*a*.4 and 38*b*.6, substantially to the through openings 210A.5, 210A.6, 210A.8 and 210A.9 known from FIG. 2. In the preferred embodiment according to FIG. 4, the preferably circular cross-sectional area of the through openings 210C.5, 210C.6, 210C.8 and 210C.9 have a diameter D3_1 that is smaller than the DA1, DA2 of the suction holes 38*a*, 38*b*, its diameter D3_1 in this case preferably being between 4 and 9 mm, in particular between 5 and 7 mm, particularly preferably approximately 6 mm.

Further, with the through opening 210C.1, the third group 260C comprises a fifth element, whose centroid 230C.1 is disposed between the circumcircle diameters 220Ca, 220Cb in such a manner that the cross-sectional area of the through opening 210C.1 fills to at least 50%, preferably to at least 70%, in particular preferably to at least 80%, a common intersecting area formed by notional overlapping of the suction holes 38*a*.1 and 38*b*.1. In a preferred embodiment according to FIG. 4, a diameter D3_2 of the circular cross-sectional areas of the through openings 210C.1 in this case is between 4 and 9 mm, in particular between 5 and 7 mm, particularly preferably approximately 6 mm.

Figure 5:
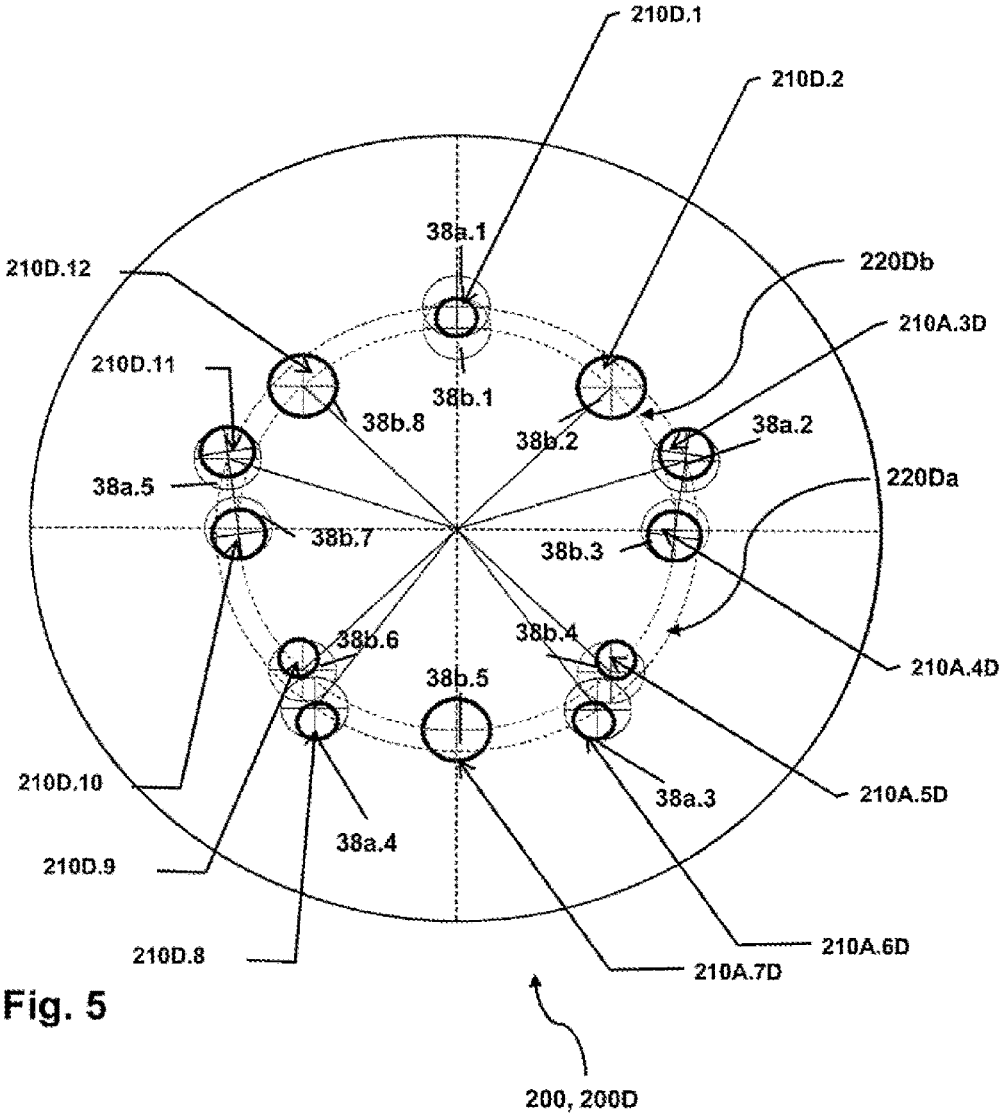
FIG. 5 shows a fourth exemplary embodiment of an exchangeable abrasive means according to the disclosure; and FIG, 6 shows a table title Table 1, which summarizes the main key data of the preferred exemplary embodiments according to FIGS. 2 to 5.

FIG. 5 shows a further variant of an exchangeable abrasive means 200, similar to FIG. 3, as a fourth preferred exemplary embodiment 200D. In this embodiment, the first group 240D corresponds in its design to the first group 240B from FIG. 3, such that reference is made here to the description of the latter. Likewise, the second group 250D corresponds in its disposition to the second group 240B of the example according to FIG. 3, such that, in this respect, likewise, reference is made to the previous description. In the embodiment according to FIG. 5, however, a different particularly preferred diameter of the through openings 210D.5, 210D.6, 210D.8 and 210D.9 that correspond to the through openings 210B.6, 210B.7, 210B.9 and 210B.10 according to FIG. 3 has been selected, at approximately 6 mm.

Unlike the exemplary embodiment according to FIG. 3, the embodiment according to FIG. 5 has, in the third group 260D, only one fifth additional through opening 210D.1, which is like the through opening 210C.1 of the exemplary embodiment according to FIG. 4, and reference is made here to the description of the latter.

FIG. 6 shows Table 1, which summarizes the main key data of the preferred exemplary embodiments according to FIGS. 2 to 5. In this table, ΣA denotes the sum of the cross-sectional areas of the through openings of the respective example. In the case of the embodiments 200A, 200B, 200C, 200D according to the disclosure, this sum cross-sectional area is less than 6%, preferably less than 5%. Furthermore, in this case, ΣA_8_effective denotes the cross-sectional area that is effectively available for suction extraction when the respective abrasive means 200A, 200B, 200C, 200D is disposed on an eight-hole version abrasive-means carrier 34 (5" pad (8 suction holes)). In the preferred embodiments, this area proportion, in relation to the total area of the abrasive means, is in this case less than 4% and, at the same time in this case, leaves free at least 35%, preferably at least 45%, particularly preferably at least approximately 50% of a sum cross-sectional area of the suction holes 38*b*.1 to 38*b*.8 for suction extraction. Furthermore, in this case, ΣA_5_effective denotes the cross-sectional area that is effectively available for suction extraction when the respective abrasive means 200A, 200B, 200C, 200D is disposed on a five-hole version abrasive-means carrier 34 (5" pad (5 suction holes)). In the preferred embodiments, this area proportion, in relation to the total area of the abrasive means, is in this case less than 3%, preferably less than 2.5% and, at the same time in this case, leaves free at least 35%, preferably at least 45%, particularly preferably at least approximately 70% of a sum cross-sectional area of the suction holes 38*a*.1 to 38*a*.5 for suction extraction. The preferred embodiments according to FIGS. 2 to 5 provide abrasive means according to the disclosure that, on the one hand, ensure highly efficient suction extraction via the operatively effective cross-sectional areas of the respectively active through openings 210A, 210B, 210C, 210D and, on the other hand, do not exhibit any perceptible impairments in respect of the available working area of the abrasive means. Tests in this case have demonstrated that, beyond an area loss of approximately 6%—for example, because of through openings provided for suction extraction in the abrasive means—there are perceptible impairments in the material removal capability of the abrasive means.

Persons skilled in the art may achieve further embodiments according to the disclosure by, in particular, appropriately combining the features of the previously described embodiments. Persons skilled in the art may achieve further embodiments according to the disclosure by realizing the cross-sectional areas of at least one of the groups of through openings so as to be non-circular; thus, for example, triangular, square or higher-polygonal contour forms may be advantageous realizations of through openings within the meaning of the disclosure. Preferably, such contours of through openings can be made in a prefabricated abrasive means by machining operations of punching or cutting such as, for example, laser cutting. In particular, however, the disclosure is not limited to abrasive discs, in particular thin, flexible abrasive discs, but may also be advantageously applied with other exchangeable abrasive means, known to persons skilled in the art, for driving by means of abrasive-means carriers described at the outset.

What is claimed is:

1. An exchangeable abrasive mechanism for use on an abrasive-mechanism carrier of an abrasion appliance that has suction holes, the abrasive-mechanism carrier having either five or eight circular suction holes that each have substantially a same diameter and are disposed either on a first, larger hole-circle diameter or a second, smaller hole-circle diameter on the abrasive-mechanism carrier, the abrasive mechanism comprising:

a body; and a plurality of through openings formed in the body, each through opening having a cross-sectional area that defines a centroid, the plurality of through openings differentiated into three groups of through openings, the groups differing from each other in a radial disposition of the centroids of the respective through openings, the three groups including:

a first group of through openings having at least two, but not more than four, through openings of a first cross section, wherein at least two of the through openings of the first group are disposed on a first circumcircle diameter that is substantially identical to one of the hole-circle diameters such that, when the abrasive mechanism is correctly disposed on the abrasive-mechanism carrier, the at least two through openings are in direct alignment with two suction holes respectively assigned to them; and a second group of through openings of a second cross section having at least four through openings that are disposed on a second circumcircle diameter that differs from the first circumcircle diameter.

2. The exchangeable abrasive mechanism according to claim 1, wherein the second group comprises at least five through openings.

3. The exchangeable abrasive mechanism according to claim 1, the three groups further including a third group of through openings, the centroids of the through openings of the third group being disposed neither on the first circumcircle diameter nor on the second circumcircle diameter.

4. The exchangeable abrasive mechanism according to claim 3, wherein the third group comprises a plurality of through openings, the centroid of a first part of the plurality lying radially outside of the first circumcircle diameter, and a second part of the plurality lying radially inside the second circumcircle diameter, the through openings of the plurality disposed such that, when the abrasive mechanism is disposed on the abrasive-mechanism carrier, a cross-sectional area of each of the plurality of through openings is overlapped by a respective suction hole of the abrasive mechanism carrier.

5. The exchangeable abrasive mechanism according to claim 3, wherein the third group comprises at least one through opening the centroid of which is disposed between the first circumcircle diameter and the second circumcircle diameter, a cross-sectional area of this through opening being overlapped by a suction hole assigned thereto, when the abrasive mechanism is correctly disposed on the abrasive-mechanism carrier, a cross section of the respective suction hole being touched by the cross-sectional area of the through openings such that the cross-sectional area of the respective through opening lies inside the cross section of the respective suction hole.

6. The exchangeable abrasive mechanism according to claim 1, wherein the cross-sectional areas of at least one of the groups of through openings is circular.

7. The exchangeable abrasive mechanism according to claim 6, wherein the cross-sectional areas of the through openings of the first group are circular and have a uniform first diameter.

8. The exchangeable abrasive mechanism according to claim 7, wherein the first diameter of the through openings of the first group is between 70% and 105% of the diameters of the suction holes of the abrasive-mechanism carrier.

9. The exchangeable abrasive mechanism according to claim 6, wherein the cross-sectional areas of the through openings of the second group are circular and have at least one differing diameter, the second group including at least two sub-groups of through openings that differ in a diameter of the cross-sectional areas.

10. The exchangeable abrasive mechanism according to claim 9, wherein:

the diameter of the cross-sectional area of a first sub-group of the second group is equal to or greater than the diameter of the cross-sectional area of the through openings of the first group, and the diameter of the cross-sectional area of a second sub-group of the second group is less than or equal to the diameter of the cross-sectional area of the through openings of the first group.

11. The exchangeable abrasive mechanism according to claim 10, wherein the first sub-group comprises at least one through opening the diameter of which being between 70% and 105% of the diameters of the suction holes of the abrasive-mechanism carrier.

12. The exchangeable abrasive mechanism according to claim 10, wherein the second sub-group comprises at least two through openings the diameters of which being between 50% and 85% of the diameters of the suction holes of the abrasive-mechanism carrier and being not greater than the diameter of the first sub-group.

13. The exchangeable abrasive mechanism according to claim 5, wherein the cross-sectional area of the through openings of the third group are circular and have at least one differing diameter, the third group including at least two sub-groups of through openings that differ in a diameter of the cross-sectional area.

14. The exchangeable abrasive mechanism according to claim 3, wherein the third group comprises five or six through openings.

15. The exchangeable abrasive mechanism according to claim 1, wherein the exchangeable abrasive mechanism is an abrasive disc.

16. The exchangeable abrasive mechanism according to claim 1, wherein the at least two of the through openings of the first group are configured to overlap the two suction holes respectively assigned to them.

17. The exchangeable abrasive mechanism according to claim 1, wherein the second cross section of the through openings of the second group is smaller than the first cross section.

18. The exchangeable abrasive mechanism according to claim 2, wherein the second group comprises exactly five or six through openings.

19. The exchangeable abrasive mechanism according to claim 5, wherein the cross section of the respective suction hole is touched at least tangentially by the cross-sectional area of the through openings.

20. The exchangeable abrasive mechanism according to claim 8, wherein the first diameter of the through openings of the first group is one or more of approximately between 80% and 100% of the diameters of the suction holes of the abrasive-mechanism carrier and between 8 mm and 10 mm.

21. An exchangeable abrasive mechanism for use on an abrasive-mechanism carrier of an abrasion appliance that has suction holes, the abrasive-mechanism carrier having either five or eight circular suction holes that each have substantially a same diameter and are disposed either on a first, larger hole-circle diameter or a second, smaller hole-circle diameter on the abrasive-mechanism carrier, the abrasive mechanism comprising:

a body; and a plurality of through openings formed in the body, each through opening having a cross-sectional area that defines a centroid, the plurality of through openings differentiated into three groups of through openings, the groups differing from each other in a radial disposition of the centroids of the respective through openings, the three groups including:

a first group of through openings having at least two, but not more than four, through openings of a first cross section, wherein at least two of the through openings of the first group are disposed on a first circumcircle diameter that is substantially identical to one of the hole-circle diameters such that, when the abrasive mechanism is correctly disposed on the abrasive-mechanism carrier, the at least two through openings are in direct alignment with two suction holes respectively assigned to them;

a second group of through openings of a second cross section having at least five through openings that are disposed on a second circumcircle diameter that differs from the first circumcircle diameter; and a third group of through openings, the third group including a plurality of through openings, and the centroids of the through openings of the third group being disposed neither on the first circumcircle diameter nor on the second circumcircle diameter.

* * * * *